US007536757B2

(12) United States Patent
Tan

(10) Patent No.: US 7,536,757 B2
(45) Date of Patent: May 26, 2009

(54) CLIP FOR JEWELLERY

(75) Inventor: Sin Cheo Tan, Penang (MY)

(73) Assignee: Amee Philips SDN BHD, Penang (MY)

( * ) Notice: Subject to any disclaimer, the term of this patent is extended or adjusted under 35 U.S.C. 154(b) by 311 days.

(21) Appl. No.: 11/572,412

(22) PCT Filed: Jul. 8, 2005

(86) PCT No.: PCT/GB2005/002700

§ 371 (c)(1),
(2), (4) Date: Jan. 23, 2007

(87) PCT Pub. No.: WO2006/008453

PCT Pub. Date: Jan. 26, 2006

(65) Prior Publication Data

US 2008/0040899 A1 Feb. 21, 2008

(30) Foreign Application Priority Data

Jul. 19, 2004 (MY) ..... PI 20042891

(51) Int. Cl.
*A44B 13/00* (2006.01)

(52) U.S. Cl. ..... 24/376; 24/574.1; 24/483; 24/489; 63/33; 63/35

(58) Field of Classification Search ..... None
See application file for complete search history.

(56) References Cited

U.S. PATENT DOCUMENTS 1,427,848 A * 9/1922 Rankin ..... 24/592.11
1,751,458 A * 3/1930 Valkenburg ..... 24/598.5
1,991,287 A * 2/1935 Martin ..... 24/600.2
3,094,754 A * 6/1963 Wayne ..... 24/116 R (Continued)

FOREIGN PATENT DOCUMENTS

DE 197 14 754 4/1998

OTHER PUBLICATIONS

International Search Report from the corresponding PCT/GB2005/002700, mailed Oct. 28, 2005.

*Primary Examiner*—Jack W. Lavinder
(74) *Attorney, Agent, or Firm*—Hamre, Schumann, Mueller & Larson, P.C.

(57) ABSTRACT

The present invention relates generally to a versatile clip for jewellery which functions as the link between the necklace and exchangeable pieces of jewellery comprising a front member (4) and a rear member (6) having curved profiles and hinged at one end whilst the respective engaging ends (10A), (10B) of the front and rear members (4), (6) opposing the hinge (8) are capable of being integrally latched to assume a central aperture (12); said engaging end (10A) of the front member (4) opposing the hinge (8) is provided with an indented notch (16A) to accommodate a hook (18) having one end (20) permanently fixed on the outer surface (22) of the front member (4) adjacent to the base (16C) of the indented notch (16A) and one unfixed end (24) freely extending into the indented notch (16A); said engaging end (10B) of the rear member (6) opposing the hinge (8) is also provided with an indented notch (16B) to snugly encompass the free unfixed end (24) of the hook (18) to hold the pendant captive when the engaging ends (10A) (10B) are latched in interlocking relationship.

28 Claims, 5 Drawing Sheets

U.S. PATENT DOCUMENTS 3,309,743 A * 3/1967 Verri ..... 24/116 R
3,599,298 A * 8/1971 Anderson ..... 24/598.5
3,956,805 A * 5/1976 Stroh ..... 24/505
4,480,589 A * 11/1984 Schneider ..... 119/865
5,782,108 A * 7/1998 Cannata et al. ..... 63/35
6,088,884 A 7/2000 Hentz
2003/0029192 A1 2/2003 Haber

* cited by examiner

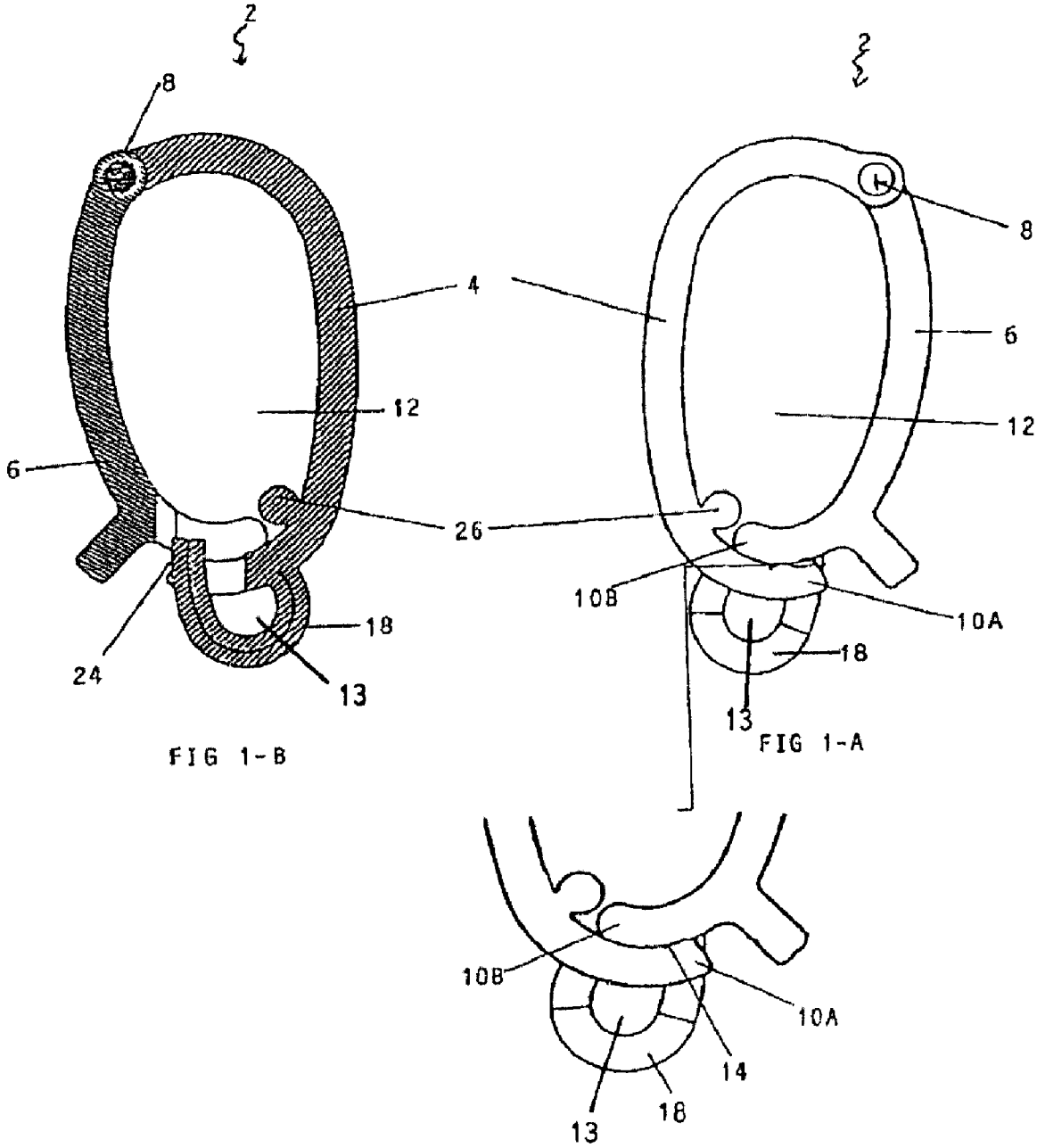
FIG 1-B
FIG 1-A

CLIP FOR JEWELLERY

TECHNICAL FIELD OF THE INVENTION

The present invention relates generally to a clip for jewellery which functions as the link between a necklace and jewellery pieces such as pendants.

BACKGROUND OF THE INVENTION

Since time immemorial women and jewellery are inseparable. Women generally love to adorn themselves with jewellery as jewellery symbolizes wealth. The wealthy are willing to spend hundreds of thousands of dollars or even millions to acquire an exquisite or rare piece of jewellery or to have a collection of various jewellery items so that they can wear different pieces of jewellery with different attire to match the different occasions and moods. Unfortunately to be able to match the attire, mood or the occasion a large collection of jewellery has to be acquired and this is only possible if one is of a sound financial standing. The less wealthy has to therefore settle with having fewer jewellery items to show.

The above setback is because conventionally jewellery items in particular a pendant or locket would comprise a gemstone set in gold or silver. A decorative pendant loop or a simple loop, forming part of the casing for mounting the gemstone, is a permanent feature through which a necklace is threaded therethrough. Due to the permanency of the pendant loop it is not possible for the wearer to wear a necklace that has an overall diameter larger than the circumference of the pendant loop with the particular piece of pendant. This means that the flexibility of interchanging different necklaces and the pendants is restricted by reason of the dependency on their sizes that is whether the pendant loop can accommodate the overall diameter of the necklace. In other words a person who wants to wear a variety of different jewellery pieces for different attire or occasions has to indeed have a substantial collection of jewellery items and the interchanging of jewellery pieces is restricted to a large extent.

Another shortcoming of the conventional type of pendants having a permanently fixed pendant loop is the inability to have variations by simultaneously wearing combinations of two or three small pieces of jewellery items capable of bringing about a more attractive and impressive effect on the wearer or giving the impression that the wearer has acquired a new piece of jewellery.

For the jewellery wearer to purchase larger decorative pendant loops to ensure they match necklaces or chains of different thickness and circumference is very costly.

It would hence be extremely advantageous and cost saving if a decorative clip, which is not only simple to use but allows versatility by allowing interchange of jewellery pieces and combination with necklaces unrestricted by the circumference of the pendant loop, is made available. It is therefore an aim of the invention to provide such a clip.

SUMMARY OF THE INVENTION

Accordingly, it is the primary aim of the present invention to provide a versatile clip for jewellery having an integral latch operated with a single application of finger pressure capable of linking a wide range of necklaces with a wide range of pendants;

It is yet another object of the present invention to provide a versatile clip for jewellery having an integral latch operated by a single application of finger pressure capable of being used with large diameter chains and necklaces including pearl necklaces;

It is yet another object of the present invention to provide a versatile clip for jewellery having an integral latch operated by a single application of finger pressure which is simple and easy to use;

It is yet another object of the present invention to provide a versatile clip for jewellery having an integral latch operated by a single application of finger pressure which allows quick exchange of jewellery pieces for different occasions and the wearer has the flexibility of interchanging the jewellery items without being restricted by the size of the pendant loop;

It is yet another object of the present invention to provide a versatile clip for jewellery having an integral latch operated by a single application of finger pressure allowing the simultaneous wearing of at least two pieces of pendants thereby making the combination as a whole more impressive and outstanding;

It is yet another object of the present invention to provide a versatile clip for jewellery having an integral latch operated by a single application of finger pressure which acts as an enhancer for any pendant capable of giving a new look to a piece of old or plain jewellery;

It is yet another object of the present invention to provide a versatile clip for jewellery having an integral latch operated by a single application of finger pressure which allows the user to clasp the versatile clip on the necklace even when the necklace is being worn around the neck;

It is yet another object of the present invention to provide a versatile clip for jewellery having an integral latch operated by a single application of finger pressure which is capable of being used to clip rings by locating in the aperture;

It is yet another object of the present invention to provide a versatile clip for jewellery having an integral latch operated with a single application of finger pressure which allows such variations that a person without much jewellery pieces may be seen to have a moderate collection of jewellery;

It is yet another object of the present invention to provide a versatile clip for jewellery having an integral latch operated by a single application of finger pressure which is capable of holding the pendants captive in the latched state.

These and other objects are addressed by the present invention, which in a first aspect provides:

A clip (2) for jewellery, the clip comprising a loop portion (4) to which a first jewellery piece can be attached, and a gate portion (6) attached to the loop portion, the gate portion being moveable between an open position in which the loop portion (4) is open so that the first jewellery piece can be attached to and detached from the loop portion (4), and a closed position in which the loop portion is closed so that the first jewellery piece cannot be removed from the loop portion (4), wherein the clip further includes jewellery piece engaging means (18) to which a second jewellery piece can be attached and detached when the gate portion (6) is open, but from which the second jewellery piece cannot be detached when the gate portion (6) is closed.

This arrangement preferably ensures that the first jewellery piece, which in use is attached to the loop portion, is held on the clip separately from the second jewellery piece, which in use is attached to the jewellery engaging means. In other words, the first and second jewellery pieces are not interchangeable with each other once the gate portion has been closed. Thus, it is preferred that closure of the gate portion prevents the first jewellery piece from being moved from the loop portion to the jewellery engaging piece. It is also preferred that closure of the gate portion constrains the second jewellery piece on the jewellery engaging means. Preferably the second jewellery piece is prevented from moving from the jewellery engaging means onto the loop portion or the gate portion.

Suitably, the loop portion and gate portion enclose a first jewellery piece aperture that is formed when the gate portion is in the closed position. Preferably the clip accommodates the first jewellery piece in the first jewellery piece aperture formed between the loop and gate portions. In addition, for example at the same time as the first jewellery piece is maintained on the clip by the loop and gate portions, a second jewellery piece can be accommodated on the jewellery piece engaging means. When the gate portion is closed, the second jewellery piece cannot be removed from the jewellery piece engaging means. Preferably, the jewellery engaging means defines a second jewellery piece aperture when the gate portion is closed, wherein the first jewellery piece cannot move from the first jewellery piece aperture to the second jewellery piece aperture when the gate portion is shut. Similarly it is preferred that the second jewellery piece cannot move from the second jewellery piece aperture to the first jewellery piece aperture when the gate portion is closed.

It is possible to attach two or more jewellery pieces to the loop and gate portions, for example within first jewellery piece aperture 12. For example, a chain and a "ring" type pendant can both be accommodated in aperture 12, formed by closing the loop and gate portions. A further jewellery piece may be attached to the second jewellery piece engaging means, e.g. to the second jewellery piece aperture (13) formed by the jewellery engaging means when the gate portion is closed.

Reference to jewellery piece herein is intended to mean any item or component of jewellery that could feasibly be attached to or connected to another item or component of jewellery. Typically these jewellery pieces will have a loop or other means by which they can be attached to the clip; in some case (e.g. a chain) they can be a loop. In particular, the term jewellery piece is a reference to a pendant and a chain. Thus, in one embodiment a first jewellery piece is a chain (necklace), which is held within the loop portion when closed by the gate portion, and a second jewellery piece is a pendant, which is held on the jewellery engaging means when the gate portion is closed. Of course, the arrangement could be reversed, with the chain being attached to the jewellery engaging means and the pendant being held within the loop and gate portions.

Preferably the jewellery piece engaging means (18) includes a hook. A hook is preferred because it is relatively easy to attach a jewellery piece (e.g. a pendant) to a hook, and the open end of the hook can be blocked to prevent the removal of the jewellery piece. Alternatives to a hook are also possible.

Preferably the gate portion (6) is hinged to the loop portion (4) so that the two portions can move relative to each other. However, alternative connections between the loop and gate portions are possible.

Preferably the gate portion (6) and loop portion (4) include latching means (11) so that in a closed position the loop and gate portions are in latching engagement. Suitably, if the clip includes latching means, there is no need for a distinct locking mechanism, e.g. the double wire loops used to secure a bracelet. Nevertheless, the clip may include, instead of or as well as the latching means, a wire lock to secure the loop and gate portions together.

Preferably the latching means causes one or both of the loop and gate portions (4), (6) to be deformed during closure of the clip.

Preferably the latching means is provided by a raised lip, tip or protrusion on one of the respective engaging ends (10A), (10B) of the loop and gate portions (4), (6).

Preferably the raised lip (11) is formed as part of the curved profile of one of the respective engaging ends (10A), (10B).

Preferably the latching means provides an obstacle or hurdle to the movement of the engaging ends when the two engaging ends are moved together. Preferably the latching means causes one or both of the loop and gate portions (e.g. the engaging ends thereof) to be deformed during closure of the clip (e.g. so that a force, e.g. finger pressure, must be applied to overcome the obstacle). Once the obstacle has been overcome (e.g. the engaging ends have moved past the latching means, the overlap increases) the loop and gate portions preferably return to their normal shape.

Suitably, the latching means is provided by a raised lip or tip on one of the engaging ends (e.g. the loop portion) that acts as an obstacle, or a raised member or protrusion on one of the engaging ends (e.g. the loop portion).

Preferably, the jewellery piece engaging means are located on the loop portion. Alternatively, the jewellery engaging means can be located on the gate portion.

Preferably the jewellery piece engaging means (18) are located on the outside of the loop portion (4).

Preferably the loop portion (4) and gate portion (6) are curved.

Preferably when the gate portion is in a closed position, a substantially oval aperture is formed between the loop and gate portions. The first jewellery piece, e.g. a chain, can be attached to the clip by opening the gate portion, encompassing the jewellery piece between the loop and gate portions and closing the clip. Alternatively or additionally a jewellery piece can be attached to the clip by threading it through the aperture, i.e. without necessarily having to open the gate portion.

Preferably, in a closed position respective engaging ends (10A), (10B) of the loop portion (4) and gate portion (6) are in overlapping arrangement.

Preferably, in the closed position the loop portion engaging end (10A) lies on the outer side of the gate portion engaging end (10B).

Preferably one or both of the engaging ends (10A), (10B) include overlap limitation means to restrict the extent of the overlap of the engaging ends.

Preferably the overlap limitation means includes a laterally directed protrusion (26) raised from the inner surface (28) of the loop portion or gate portion (4).

Preferably the engaging end (10A) of the loop portion (4) includes a notch or cut-away portion (16A) to accommodate the jewellery piece engaging means (18).

Preferably the hook (18) has one end (20) permanently fixed on the outer surface (22) of the loop portion (4) adjacent to the base (16C) of the notch (16A) and one unfixed end (24) freely extending into the notch (16A). In fact, the hook (or other engaging means) can be fixed to any part of the loop portion.

Preferably said engaging end (10B) of the gate portion (6) is also provided with a notch (16B) to encompass the free unfixed end (24) of the hook (18) to hold the second jewellery piece captive when the gate portion is closed. Alternatively, the hook (or other engaging means) can be fixed to the gate portion, with a free end extending into a notch at the engaging end of the gate portion, and the loop portion has a notch which encompasses the free end of the hook to hold the second jewellery piece captive when the gate portion is closed.

Preferably the notch and hook are arranged so that the alignment of the loop and gate portions is maintained. A snug fit between the notch and loop is therefore preferred.

Preferably the width of the notch (16B) of the gate portion (6) (or the notch of the loop portion in the alternative arrangement) is narrower than the width of the notch (16A) of the loop portion (or gate portion in the alternative arrangement) to enable the unfixed end (24) of the hook (18) to be snugly encompassed, thereby holding any jewellery piece on the hook (18) captive.

A similar arrangement is possible for other engaging means.

Preferably the gate portion can be opened and closed by application of finger pressure. Preferably only a single application of finger pressure is required. Suitably, the clip includes lever means (30) for assisting the opening of the gate portion (6). Preferably the lever means include a laterally directed protrusion (30) raised from the outer surface (32) of the gate portion (6).

Features of the preferred arrangement described below, as well as the embodiments discussed in the detailed description, may be applied individually or in any combination to the clip of the first aspect defined above.

In the following description, including the detailed description the terms "front member" and "rear member" are examples of a loop portion and a gate portion respectively.

In a preferred arrangement, the present invention provides a self latching versatile clip (2) for jewellery operated by a single application of finger pressure comprising a front member (4) and a rear member (6) having curved profiles and hinged at one end whilst the respective engaging ends (10A), (10B) of the front and rear members (4), (6) opposing the hinge (8) are capable of being integrally latched to assume a central aperture (12); said engaging end (10A) of the front member (4) opposing the hinge (8) is provided with an indented notch (16A) to accommodate a hook (18) having one end (20) permanently fixed on the outer surface (22) of the front member (4) adjacent to the base (16C) of the indented notch (16A) and one unfixed end (24) freely extending into the indented notch (16A); said engaging end (10B) of the rear member (6) opposing the hinge (8) is also provided with an indented notch (16B) to snugly encompass the free unfixed end (24) of the hook (18) to hold the pendant captive when the engaging ends (10A) (10B) are latched in interlocking relationship; said front member (4) is further provided with a laterally directed protrusion (26) raised from the inner surface (28) of the front member (4) at a predetermined position adjacent to the base (16C) of the indented notch (16A) which acts as a means to limit the overlapping of the engaging end (10B) of the rear member (6) over the engaging end (10A) of the front member to maintain the shape of the clip.

In a second aspect, the present invention provides a piece of jewellery including a clip according to the first aspect, wherein the piece of jewellery includes a chain that is accommodated between the loop and gate portions and a pendant that is attached to the jewellery piece engaging means.

In a further aspect the present invention provides a kit including a clip according to the first aspect, the kit including two or more chains and two or more pendants, wherein a selected chain may be interchangeably joined to any one of the pendants by opening the clip, placing the selected chain between the loop and gate portions of the clip, placing the selected pendant on the jewellery piece engaging means, and closing the clip.

BRIEF DESCRIPTION OF THE DRAWINGS

Other aspect of the present invention and their advantages will be discerned after studying the Detailed Description in conjunction with the accompanying drawings in which:

FIG. 1-A shows a two dimensional view of the preferred embodiment of the present invention in the latched state;

FIG. 1-B shows a cross section through the symmetrical centre of FIG. 1;

DETAILED DESCRIPTION OF THE DRAWINGS

The invention will be more clearly understood from the following description of the embodiments thereof, given by way of example only with reference to the accompanying drawings which are not drawn to scale.

Figure 1:
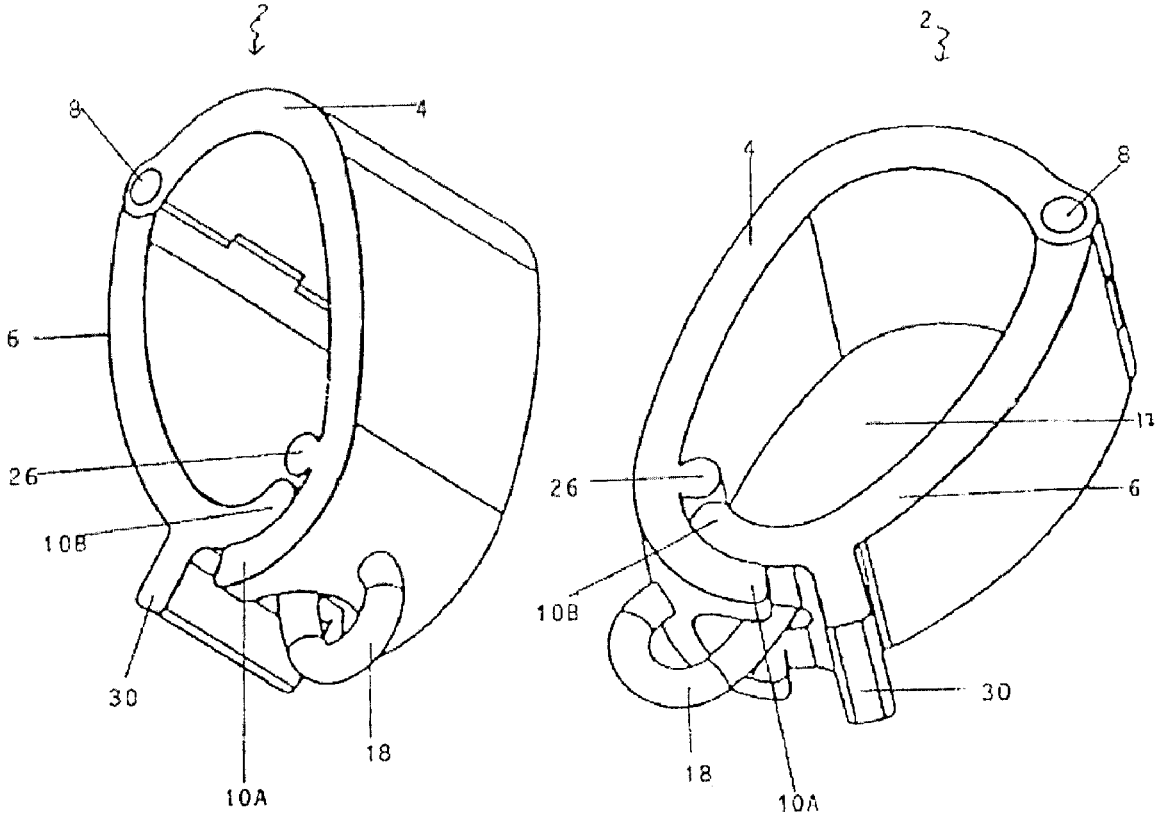
FIG. 1 shows 3-dimensional views of the preferred embodiment of the present invention in the latched state.

Referring to FIG. 1, 3-dimensional views of the preferred embodiment of the versatile clip (2) for jewellery in a latched state comprising two parts namely a front member (4) and a rear member (6) joined by a hinge (8). Both the front and rear members (4), (6) have curved profiles so that when the respective engaging ends (10A) (10B) of the front and rear (4), (6) members are in an interlocking relationship (the engagement is explained below) so as to form an integral latch, a central aperture (12) preferably having an oval configuration results. The size and configuration of the said aperture (12) is dependant on the length and profile of the front and rear member (4),(6) and can be made to accommodate necklaces of different sizes and configurations.

Referring to FIG. 1-A, a two dimensional view of the preferred embodiment of the present invention in the latched state. In a latched state the inner surface of the engaging end (10A) of the front member (4) meets the outer surface of the engaging end (10B) of the rear member (6); said meeting surface being enlarged and indicated by the numeral (14) in the FIG. 1-A. The meeting surfaces (14) of the first and second engaging ends (10A) (10B) forms a secure latch.

Referring to FIG. 1-B, a cross section through the symmetrical centre of FIG. 1 illustrates the clip (2) in its latched state and the preferred position of the unattached free end (24) of the hook (18) which is encompassed by the indented notch (16B) of the engaging end (10B) of the rear member (6) enabling the pendant (not shown) to be held captive.

Figure 2:
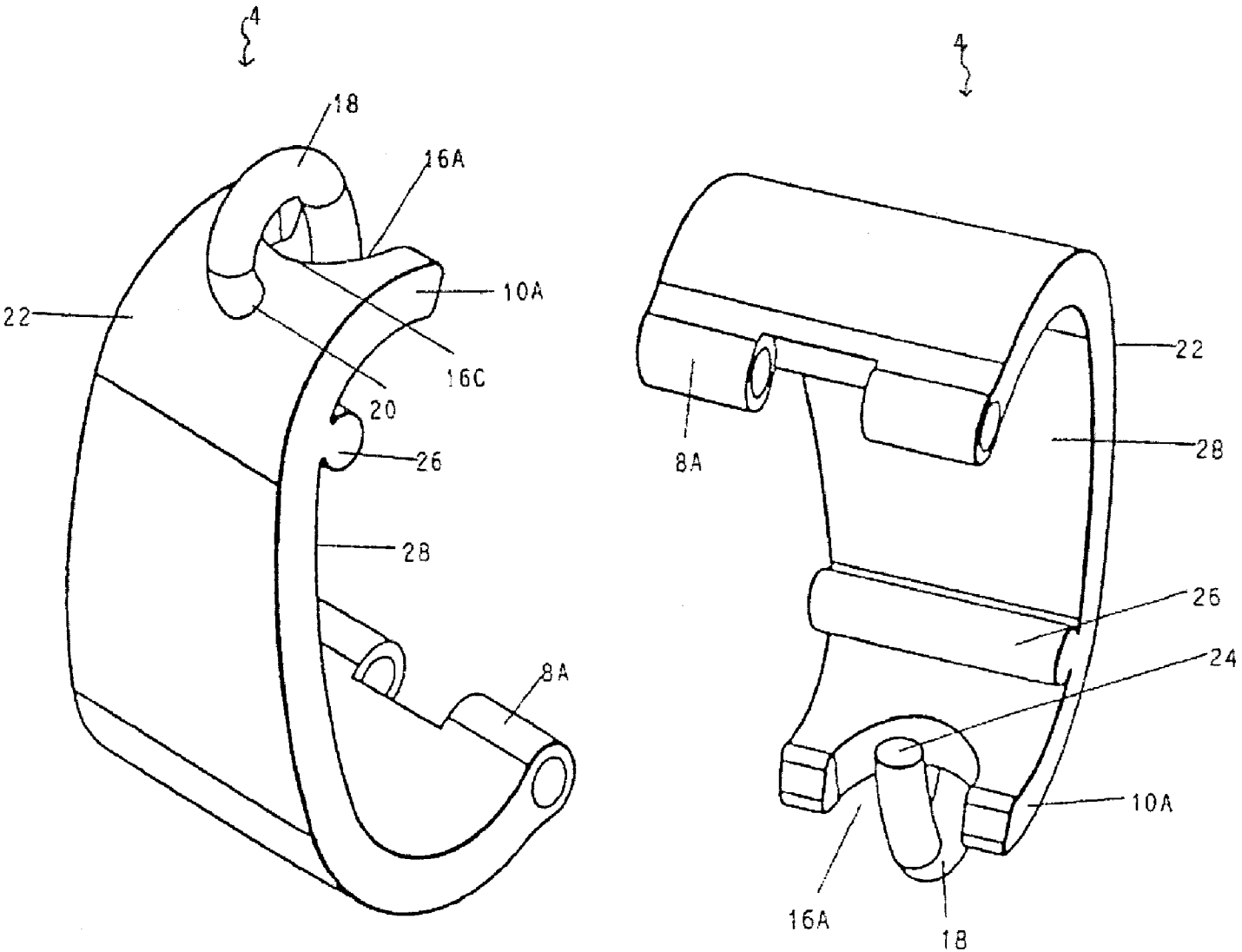
FIG. 2 shows 3-dimensional views of the disassembled front member of the versatile clip.
Figure 3:
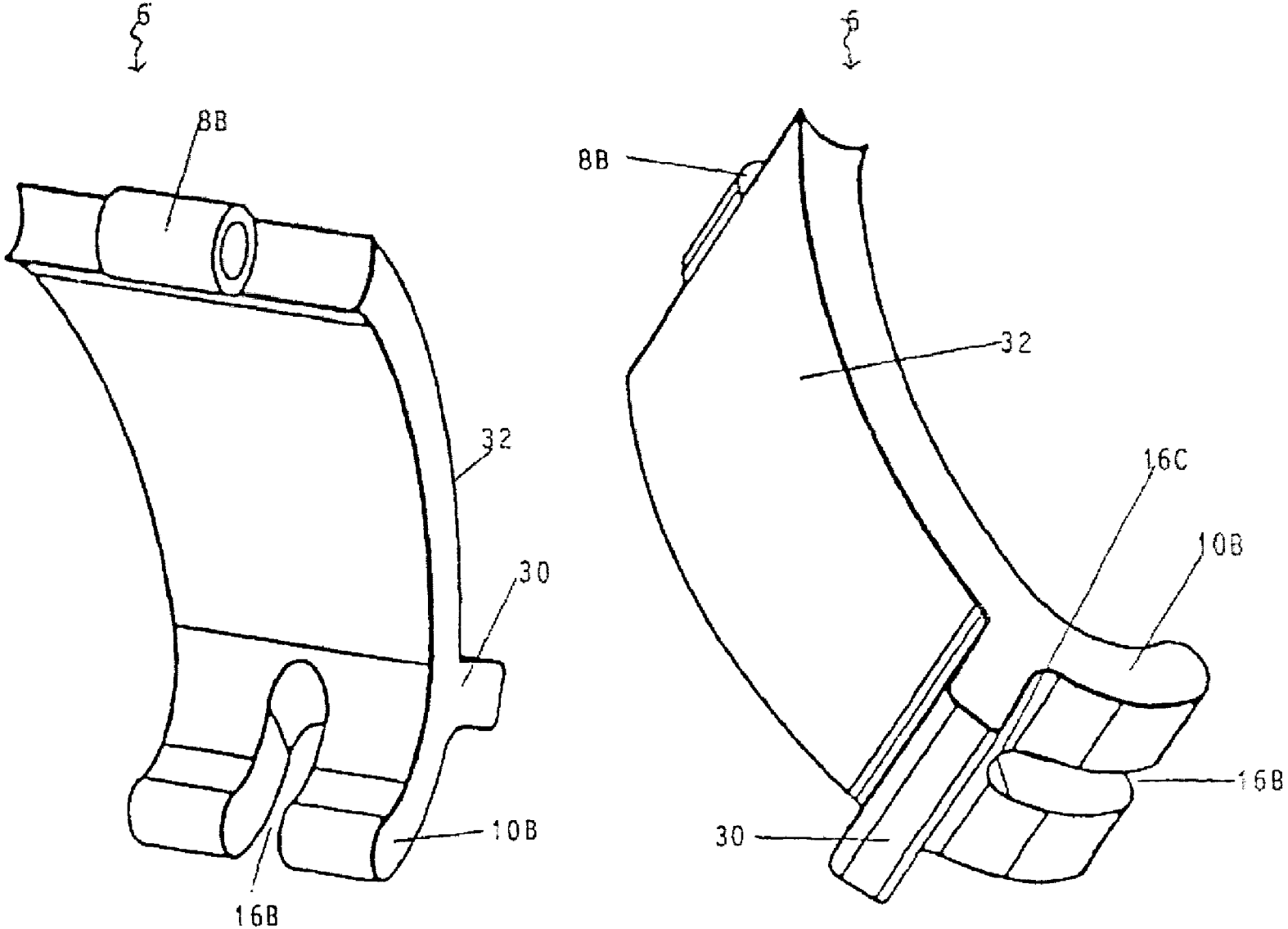
FIG. 3 shows 3-dimensional views of the disassembled rear member of the versatile clip.

Referring to FIG. 2, 3-dimensional views of the disassembled front member (4) of the versatile clip (2). The front member (4) has a curved profile provided with a first hinged end (8A) and a first engaging end (10A). The first hinged end (8A) is configured to complementarily fit the second hinged end (8B) of the rear member (6) [See FIGS. 1 and 3]. The first engaging end (10A) which is opposing the first hinged end (8A) has a first indented notch (16A) preferably U-shaped to accommodate a hook (18) in between the two sides of the first U-shaped indented notch (16A). The hook (18) has one fixed end (20) permanently provided on the outer surface (22) of the front member (4) and preferably located at a predetermined position adjacent to the base (16C) of the first indented notch (16A) whilst the free unattached end (24) terminates above the inner surface of the first U-shaped indented notch (16A). The front member (4) is further provided with a laterally directed protrusion (26) raised from its inner surface (28) at a predetermined surface adjacent to the base (16C) of the first U-shaped indented notch (16A). The laterally directed protrusion (26) may be configured to have one side raised from the inner surface (28) of the front member (4) acting as a stopper whilst its other opposing side meets or gradually tapers along with the curvature of the inner surface (28) of the front member (4). The laterally directed protrusion or stopper (26) being located on the inner surface (28) of the front member (4) is used to prevent the second engaging member (10B) of the rear member (6) from exceeding a preferred point when engaged to the first engaging end (10A) thereby preventing distortion of the curvature of the aperture thereby keeping the shape of the clip constant.

Referring to FIG. 3, 3 three dimensional views of the disassembled rear member (6) of the versatile clip (2). The rear member (6) also has a curved profile provided with a second hinged end (8B) and a second engaging end (10B). The second hinged end (8B) is configured to complementarily fit the first hinged end (8A) of the front member (4) [See FIGS. 1 and 2]. The second engaging end (10B) which is opposing the second hinged end (8B) has a second indented notch (16B) preferably U-shaped to accommodate and encompass the hook (18) when the second engaging end (10B) of the rear member (6) is in interlocking relationship with the first engaging end (10A) of the front member (4). The width of the gap of the second indented notch (16B) is of such measurement capable of encompassing the hook (18) snugly leaving no gaps big enough for the pendant to slip out of the hook (18) and is preferably narrower than the width of the gap of the first indented notch (16A) of the front member (4). Thus the pendant is held captive and there is no possibility for the pendant or locket to drop off the hook (18) once the engaging ends (10A) (10B) are in a latched state.

The front member (4) is preferably longer than the rear member (6) so that when the first hinged end (8A) of the front member (4) is complementarily joined to the second hinged end (8B) of the rear member (6) to form a hinge (8), the hinge (8) will not be visible from the front. This is not only for aesthetic purposes but also to facilitate good spring effect of the front member (4) to open and close the latch.

Figure 4:
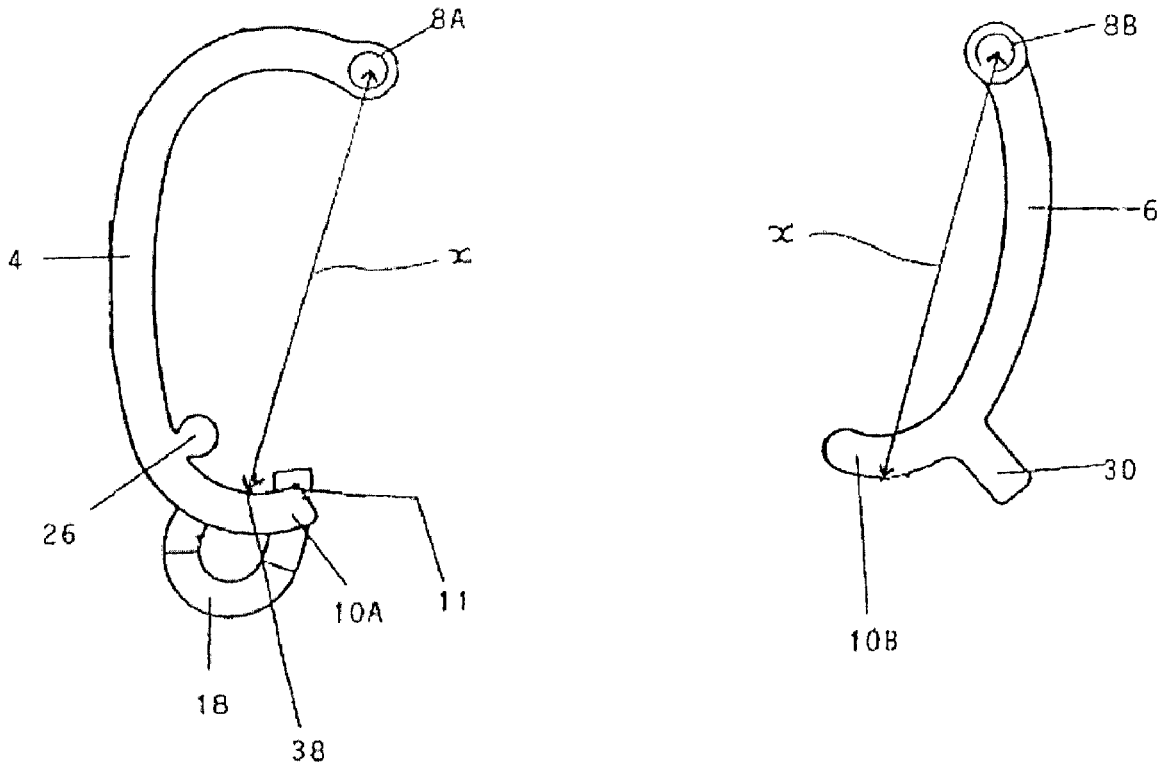
FIG. 4 shows two dimensional views of the disassembled front and rear member.

Referring to FIG. 4 a two dimensional view of the front and rear members (4) (6). The front member (4) comprises a "C" shaped configuration but with the portion provided with the hinge (8) protruding longer than the portion with the first engaging end (10A) whilst the rear member (6) comprises a configuration similar to a partial "C" section [cut transversely] wherein only the second engaging end (10B) is seen to curve out. FIG. 4 further illustrates the distance between the centre of the first hinged end (8A) and the central meeting point of the first engaging end (10A) of the front member (4) indicated by the numeral 38 being equivalent to the distance between the centre of the second hinged end (8B) and the lowest or outermost peripheral point of the second engaging end (10B) of the rear member (6), said distance being indicated by "x". In either latched or unlatched state the distance between the centre of the hinged ends (8A), (8B) and the central meeting point (38) of the engaging ends (10A), (10B) is always kept constant. The tip (11) of the first engaging end (10A) terminates at a point higher than the central meeting point (38) which acts as an obstacle or interference so that when the first and second engaging ends (10A),(10B) are initially pushed against each other by applying finger pressure, the second engaging end (10B) will forcefully push against the tip (11) of the first engaging end (10A) [which is at a higher point] which will temporarily cause the front member (4) to spring downwardly and the rear member (6) to spring upwardly thereby resulting in the ability for the second engaging end (10B) to pass over the tip (11) of the first engaging end (10A). After clearing the initial obstacle or interference which is the tip (11) of the first engaging end (10A), the front and rear members (4), (6) spring back to their equilibrium position and the distance between the centre of the hinged ends (8), (8A) and the meeting point (38) is maintained at the distance prior to engagement which is indicated as "x" in FIG. 4. It is to be noted that the said distance indicated as "x" in FIG. 4 is not necessary one suitable distance, the said distance is variable dependant on the length of the front and rear member (4), (6) and their curvature but is the same for both members (4), (6) of a single clip. The latch of the present invention is operated by the above described springing effect made possible by the configurations of the front and rear member (4), (6). The latch is prevented from disengaging without any application of force due to the interlocking relationship of the engaging ends (10A), (10B) and the higher tip (11) of the first engaging end (10A).

To unlock the versatile clip (2), the rear member (6) is further provided with a laterally directed lever (30) raised from its outer surface (32) at a predetermined position adjacent to the base (34) of the second U-shaped notch (16B) for placement of the finger. The latch is disengaged by applying sufficient finger pressure on the lever (30) as indicated in the direction of the arrow "A" to separate the engaging ends (10A) (10B) from each other.

One pendant or more may be firstly hung onto the hook (18) before the front and rear member (4), (6) of the versatile clip (2) are positioned to be clipped or clasped on the necklace while the necklace is being worn on the neck. The advantage of being able to clasp the versatile clip on the necklace whilst being worn around the neck has afforded great convenience to the user and reduces time spent to dress up as the user need not remove the necklace each time the user intends to change a different pendant to see if it matches the user's outfit. This is not possible without the versatile clip.

Whilst the said aperture has been described and illustrated in some detail as being oval in configuration the above is not necessarily the only configuration or shape that can be used. For example the aperture can have a round or oblong configuration however, what is advantageous in accordance with the present invention is the fact that the invention is capable of providing the flexibility of interchanging jewellery pieces or combining them without having to remove the item to which the versatile clip is to be clasped on.

Whilst the said first and second indentation has been described and illustrated in some detail as being provided with notches of generally "U" section the above is not necessarily the only configuration or shape that can be employed, for instance the indented notches may be of "V" or square shape however, what is advantageous in accordance with the present invention is the fact that the invention is capable of providing the flexibility of interchanging jewellery pieces or combining them without having to remove the item to which the versatile clip is to be clasped on.

Although the said hook has been described and illustrated in some detail as being provided on the outer surface of the front member, the hook can also be provided on the outer surface of the rear member.

It will also be appreciated that although the said versatile clip has been described and illustrated in some detail as being used with various jewellery items or pieces, the above is not the only usages of the clip. The clip may also be used for ornamental purposes to clip onto a bracelets and chains.

While the preferred embodiment of the present invention and their advantages have been disclosed in the above Detailed Description, the invention is not limited thereto but only by the spirit and scope of the appended claim.

What is claimed is:

1. A clip for jewellery comprising, (a) a loop portion;

(b) a gate portion;

(c) means to attach said loop portion to said gate portion;

(d) engaging means to latch said loop portion to said gate portion when said gate portion is rotated to mate said loop portion for attachment of a first jewellery piece;

(e) a jewellery piece engaging means for attachment of a second jewellery piece;

characterised in that said loop portion has a cut-away portion configured to accommodate the unfixed end of said jewellery piece engaging means;

said gate portion has a cut-away portion configured to encompass part of said unfixed end of said jewellery piece engaging means when the said gate portion is rotated to mate said loop portion;

said jewellery piece engaging means has one end fixed to the outer surface of said loop portion and the other unfixed end extending towards but not contacting the inner surface of the loop portion resulting in an externally located jewellery piece engaging means serving as a bail to enable attachment or detachment of at least one bailess second jewellery piece when gate portion is open and non-detachment of the said jewellery piece when the said gate portion is closed to encompass said unfixed end;

said engaging means is integral in the said loop and gate portion.

2. A clip according to claim 1, wherein the jewellery piece engaging means includes a hook.

3. A clip according to claim 1 wherein the jewellery piece engaging means is located on the outside of the loop and gate portions.

4. A clip according to claim 1 wherein the loop portion and gate portion are curved.

5. A clip according to claim 1, wherein when the gate portion is in a closed position, a first jewellery piece aperture is formed between the loop and gate portions through which aperture the first jewellery piece passes therethrough and a second jewellery piece aperture is externally formed by the encompassing of the jewellery piece engaging means by one of the engaging ends through which second aperture a bailess second jewellery piece is attached.

6. A clip according to claim 5, wherein the first jewellery piece aperture is a substantially oval aperture.

7. A clip according to claim 1 wherein in a closed position, respective engaging ends of the loop portion and gate portion which are integral to the loop and gate portion are in overlapping arrangement.

8. A clip according to claim 1, wherein in the closed position the loop portion engaging end lies on the outer side of the gate portion engaging end.

9. A clip according to claim 8 which includes an overlap limitation means to restrict the extent of the overlap of the said engaging ends.

10. A clip according to claim 9 wherein the overlap limitation means to restrict the extent of the overlap of the said engaging ends includes a laterally directed protrusion raised from the inner surface of the loop portion or gate portion.

11. A clip according to claim 3 wherein engaging of the latching means causes one or both of the loop and gate portions to be deformed during closure of the clip.

12. A clip according to claim 11, wherein the latching means is provided by a raised lip, tip or protrusion on one of the respective engaging ends of the loop and gate portions.

13. A clip according to claim 12, wherein the raised lip is formed as part of a curved profile of one of the respective engaging ends.

14. A clip according to claim 1, wherein the engaging end of the loop portion includes a notch or cut-away portion to accommodate the jewellery piece engaging means.

15. A clip according to claim 14, wherein the hook has one end permanently fixed on the outer surface of the loop portion adjacent to the base of the notch and one unfixed end freely extending into the notch.

16. A clip according to claim 15, wherein said engaging end of the gate portion is also provided with a notch to encompass the free unfixed end of the hook to hold at least one second jewellery piece captive when the gate portion is closed.

17. A clip according to claim 16, wherein the width of the notch of the gate portion is narrower than the width of the notch of the loop portion to enable the unfixed end of the hook to be snugly encompassed, thereby holding any jewellery piece on the hook captive.

18. A clip according to claim 1, wherein the lever means includes a laterally directed protrusion raised from the outer surface of the gate portion at a predetermined position adjacent to the base of the indented notch for the purpose of providing finger leverage for unlatching.

19. A clip according to claim 1, wherein the clip can be operated by application of finger pressure, and the loop portion comprises a front member and the gate portion comprises a rear member, both having curved profiles and connected by a hinge at one end whilst the respective engaging ends of the front and rear members opposing the hinge are capable of being integrally latched to form a central aperture for accommodating the first jewellery piece; said engaging end of the front member opposing the hinge is provided with an indented notch to accommodate the jewellery piece engaging means comprising a hook, the hook having one end permanently fixed on the outer surface of the front member adjacent to the base of the indented notch and one unfixed end freely extending into the indented notch; said engaging end of the rear member opposing the hinge is also provided with an indented notch to snugly encompass the free unfixed end of the hook to hold the second jewellery piece captive when the engaging ends are latched in interlocking relationship.

20. A clip for jewellery as claimed in claim 18 wherein, said front member is further provided with a laterally directed protrusion raised from the inner surface of the front member at a predetermined position adjacent to the base of the indented notch which acts as a means to limit the overlapping of the engaging end of the rear member over the engaging end of the front member to maintain the shape of the clip.

21. A clip for jewellery as claimed in claim 18, wherein the operation of the latch to lock the engaging ends is by way of interference and interlocking.

22. A clip for jewellery as claimed in claim 19, wherein the distance between the centre of the hinged end of the rear member and its outermost peripheral point opposing the hinged end is equivalent to the distance between the centre of the hinged end of the front member and central meeting point of the engaging end of the front member opposing the hinged end.

23. A clip for jewellery as claimed in claim 22, wherein the tip of the engaging end of the front member is at a point higher than the central meeting point of the engaging end of the front member such that the distance from the hinge to the tip is less than the distance between the hinge and the meeting point.

24. A clip for jewellery as claimed in claim 19, wherein minimal temporary distortion is caused by interference at the initial stage of closing the clip wherein the engaging end of the front member is pushed downwardly whilst the engaging end of the rear member is pushed upwardly at the initial stage of closing the clip.

25. A clip for jewellery as claimed in claim 19, wherein the front and rear members springs back to equilibrium position after clearing the initial interference thereby maintaining said distance between the hinge and meeting surfaces at par and constant.

26. A clip for jewellery as claimed in claim 18, wherein the indented notch is of "U" shaped or V-shaped configuration or a square section.

27. A clip for jewellery as claimed in claim 18, wherein the configuration of the aperture assumed upon closing the clip is oval, round or oblong.

28. A clip for jewellery as claimed in claim 18 wherein one end of the hook is permanently fixed on the outer surface of the rear member.

* * * * *